US007251425B2

(12) United States Patent
Kameda

(10) Patent No.: US 7,251,425 B2
(45) Date of Patent: Jul. 31, 2007

(54) IMAGE FIXING APPARATUS AND IMAGE FORMING APPARATUS

(75) Inventor: Seiichiro Kameda, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 309 days.

(21) Appl. No.: 11/081,717

(22) Filed: Mar. 17, 2005

(65) Prior Publication Data

US 2005/0207771 A1 Sep. 22, 2005

(30) Foreign Application Priority Data

Mar. 22, 2004 (JP) ..... 2004-082315

(51) Int. Cl.
*G03G 15/20* (2006.01)

(52) U.S. Cl. ..... 399/68; 377/341; 377/320

(58) Field of Classification Search ..... 399/68, 399/341

See application file for complete search history.

(56) References Cited

U.S. PATENT DOCUMENTS 6,473,579 B1 10/2002 Suzuki et al. ..... 399/124
6,512,914 B2 * 1/2003 Kabashima ..... 399/68

FOREIGN PATENT DOCUMENTS

| | | | |
|---|---|---|---|
| JP | 63-116181 | | 5/1988 |
| JP | 4-245275 | | 9/1992 |
| JP | 5-2352 | | 1/1993 |
| JP | 11038819 A | * | 2/1999 |
| JP | 2000-75710 | | 3/2000 |
| JP | 2002-351237 | | 12/2002 |

* cited by examiner

*Primary Examiner*—David M. Gray
*Assistant Examiner*—Ryan D. Walsh
(74) *Attorney, Agent, or Firm*—Fitzpatrick, Cella, Harper & Scinto

(57) ABSTRACT

When the conveying speed of a sheet by a first fixing device 9*a* disposed on the upstream side of the conveying path of the sheet is defined as Vu, and the conveying speed of the sheet by pairs of conveying rollers 31, 32 and 33 provided between the first fixing device 9*a* and a second fixing device 9*b* is defined as Vm, and the conveying speed of the sheet by the second fixing device 9*b* disposed on the downstream side is defined as Vl, Vu, Vm and Vl are set to the relation that Vu<Vm<Vl.

11 Claims, 7 Drawing Sheets

DIAGRAM OF CONVEYING SPEED OF RECORDING MATERIAL IN IMAGE FIXING DEVICE

IMAGE FIXING APPARATUS AND IMAGE FORMING APPARATUS

BACKGROUND OF THE INVENTION

1. Field of the Invention

The invention relates to an image fixing apparatus for fixing a toner image on a sheet and an image forming apparatus provided with the same.

2. Description of Related Art

The following is known as an image fixing apparatus having a plurality of fixing means.

In Japanese Patent Application Laid-open No. H04-245275, it is disclosed that provision is made of two sets of fixing roller groups each comprising a pair of heating roller and pressure roller urged against each other, and design is made such that recording paper to which a toner image has been transferred is passed through first stage and second stage pressure contact portions, whereby gloss is given to the toner image after fixed, and it is described that a glossy image can be obtained by the use of two sets of fixing devices.

In Japanese Patent Application Laid-open No. H05-002352, it is disclosed that provision is made of two sets of fixing roller apparatuses each comprising a pair of heating roller and pressure roller urged against each other, and the two sets of fixing roller apparatuses are disposed so that each of the nip portions of the two sets of fixing roller apparatuses may be along a substantially straight conveying path. Also, the pressure force of each of the pressure rollers against the heating rollers of the two sets of fixing roller apparatuses is made small to such a degree as not to produce wrinkles, and a fixing property is maintained good by fixing twice correspondingly to a reduction in the fixing property caused by the pressure force being made small. In this patent application, it is disclosed that by the above-described construction, a recording medium leaves the nip position of a first fixing roller and is guided straight to the nip position of a second fixing roller, whereby the leading edge of the recording medium can be conveyed to the nip without striking against the second fixing roller, and such a shock as acts on a portion of the recording medium nipped by the first fixing roller is eliminated.

Japanese Patent Application Laid-open No. 2000-075710 discloses a fixing apparatus in which the conveying speed of a recording material by first fixing means provided on an upstream side is set higher than the conveying speed of the recording material by second fixing means provided on a downstream side so that unnecessary tension may not be applied to the recording material between the two fixing means, and which can prevent the occurrence of image misregister and the wrinkles of the paper.

There have been proposed examples of the image forming apparatus which output an image of high gloss by the use of two fixing devices, as in the above-described conventional examples, and there have been disclosed many examples in which such a problem as image misregister due to the wrinkles or shock of the recording material is caused by the two fixing devices.

In recent years, in image forming apparatuses such as copying machines and printers, there has been rising a requirement for more various types of recording materials than before such as thin sheets to thick sheets that unfixed toner images on the recording materials be fixed. Also, for the various recording materials, it has become necessary to maintain high productivity without lowering the throughput.

In the aforedescribed conventional examples, however, there has been a problem which cannot be completely solved even by the fixing apparatuses which attempt to solve such a problem as the image misregister due to the shock of the recording material as noted above. That is, in a case where the conveying speed of the recording material by the first fixing means provided on the upstream side is set higher than the conveying speed of the recording material by the second fixing means provided on the downstream side so that unnecessary tension may not be applied to the recording material by the two fixing means, if the recording material is a thin sheet, the recording material is flexed between the two fixing means to thereby give birth to an effect, but there has been the problem that if the recording material is a thick sheet, it is difficult for the recording material to be flexed and the shock with which the recording material dashes into the second fixing means is transmitted to the first fixing means to thereby give rise to image misregister.

In Japanese Patent Application Laid-open No. 2002-351237, it is disclosed that in an image forming apparatus having two fixing means, when a recording material is being conveyed by both of upstream side fixing means and downstream side fixing means, a loop amount form in the recording material is detected, and on the basis of the result of the detection, the conveying speeds of the two fixing means are determined. This, however, requires a mechanism for detecting the loop amount and a construction for changing the conveying speeds on the basis of the loop amount, and the construction of the apparatus becomes complicated and the cost of the apparatus is increased.

Also, in Japanese Patent Application Laid-open No. S63-116181, it is disclosed that two pairs of fixing rollers are provided and the speed of the fixing roller on the downstream side is made higher than that of the fixing roller on the upstream side, but there is the possibility that when a recording material is conveyed by both of the two fixing rollers, tension may be applied to the recording material to thereby disturb a toner image on the recording material, thus causing faulty fixing.

SUMMARY OF THE INVENTION

The present invention solve the above-noted problems and the object thereof is to provide such an image fixing apparatus provided with a plurality of fixing devices as will not give rise to a problem attributable to the conveying performance of a sheet even if the sheet is, for example, a sheet of great basis weight (thick sheet), and an image forming apparatus provided with the same.

In order to achieve the above object, the image fixing apparatus of the present invention has:

a first fixing device which fixes a toner image on a sheet;

a second fixing device, provided downstream of said first fixing device, which fixes the toner image on the sheet passed though said first fixing device;

a sheet conveying path, provided between said first fixing device and said second fixing device, wherein a length of said sheet conveying path is longer than a length of a longest sheet to be able to convey; and a sheet conveying means, provided on the sheet conveying path, which conveys the sheet, wherein a relation among sheet conveying speeds of said first fixing device, said sheet conveying means and said second fixing device is set to $$Vu<Vm<Vl,$$

where Vu is a sheet conveying speed of said first fixing device, Vm is a sheet conveying speed of said sheet conveying means, and Vl is a sheet conveying speed of said second fixing device.

DESCRIPTION OF THE PREFERRED EMBODIMENTS

Some embodiments of an image forming apparatus provided with an image fixing apparatus according to the present invention will hereinafter be specifically described with reference to the accompanying drawings.

Figure 1:
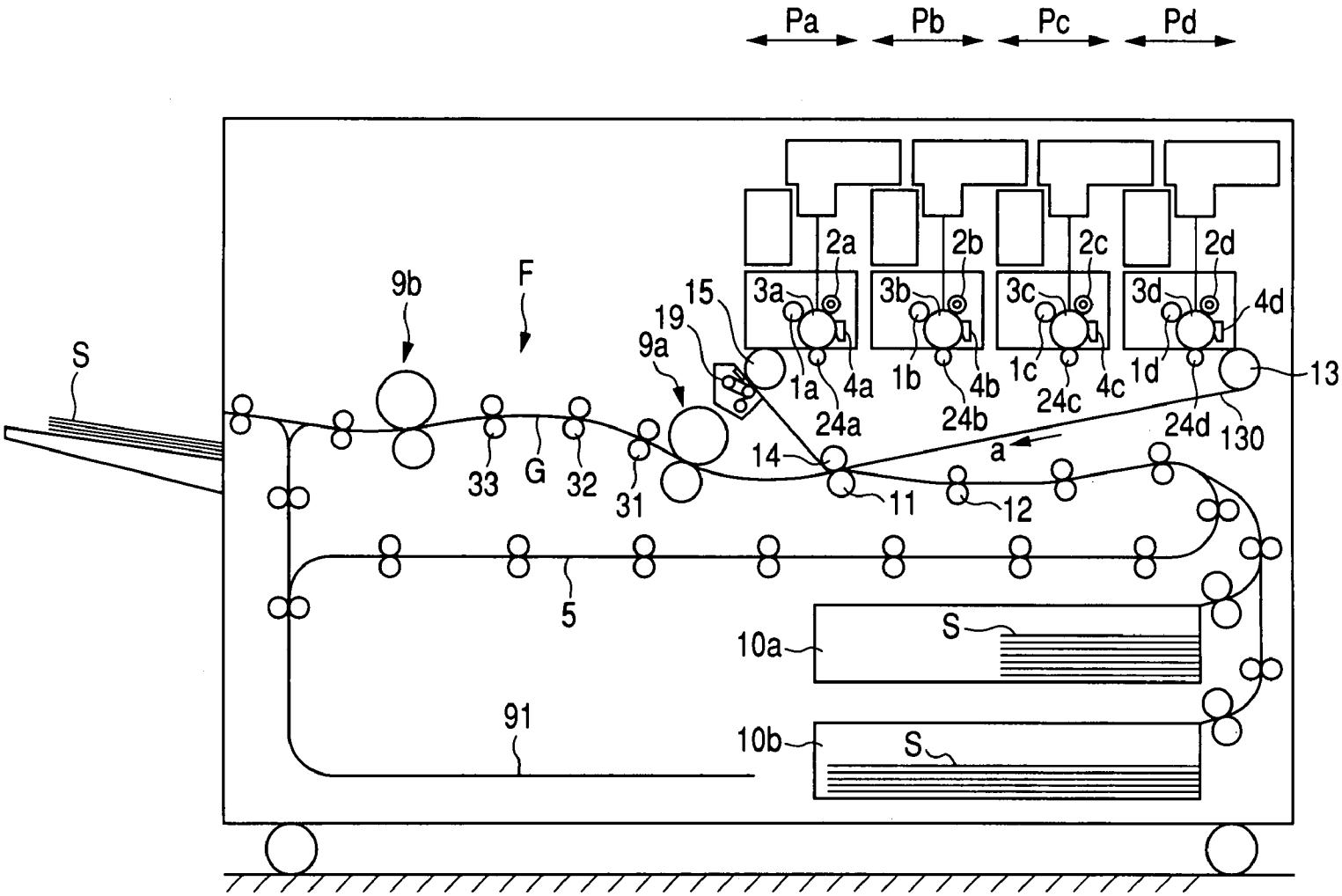
FIG. 1 is a cross-sectional illustration showing the general construction of an image forming apparatus according to the present invention.
Figure 2:
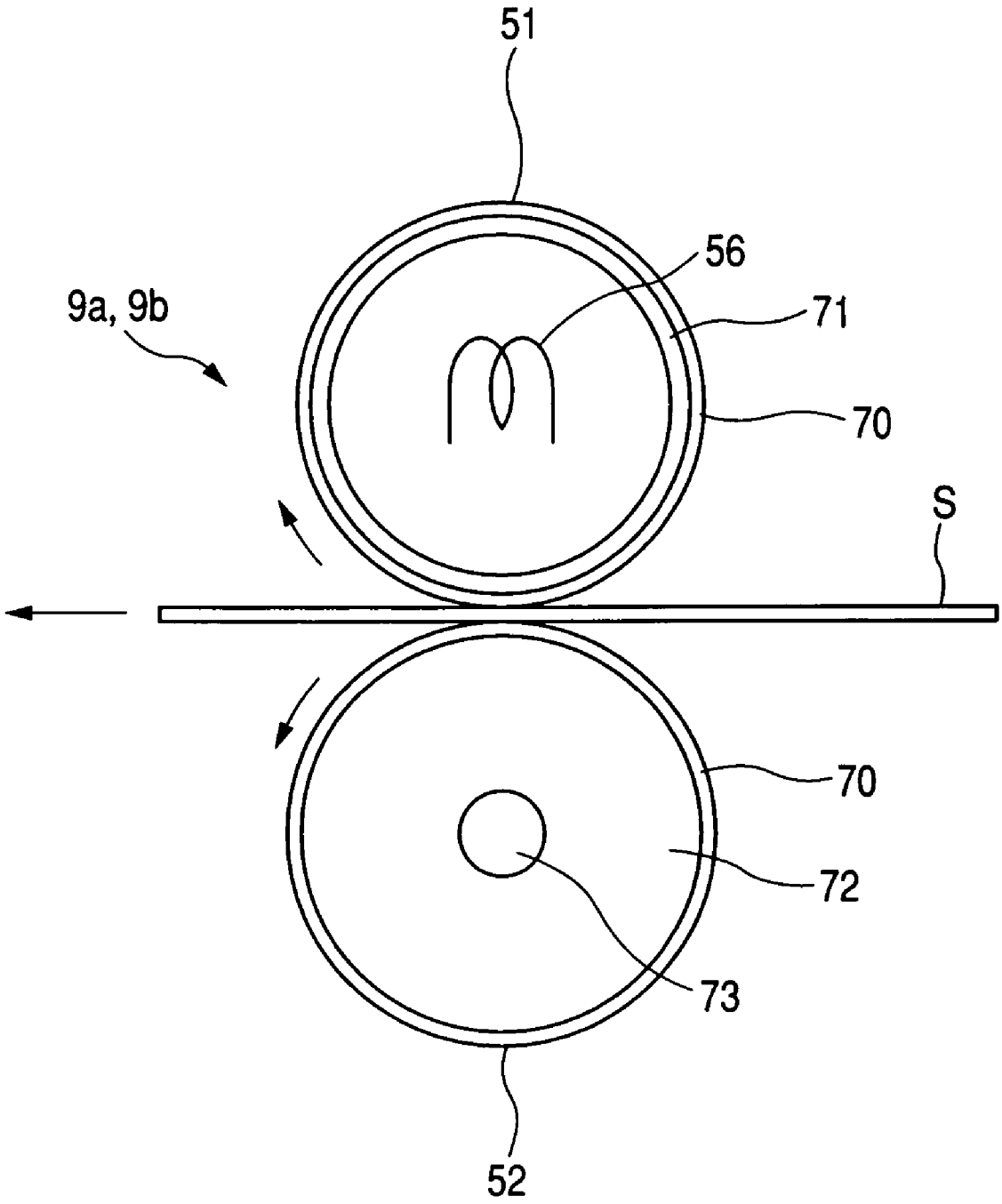
FIG. 2 is a cross-sectional illustration showing the construction of a first embodiment of fixing means provided in the image forming apparatus according to the present invention.
Figure 3:
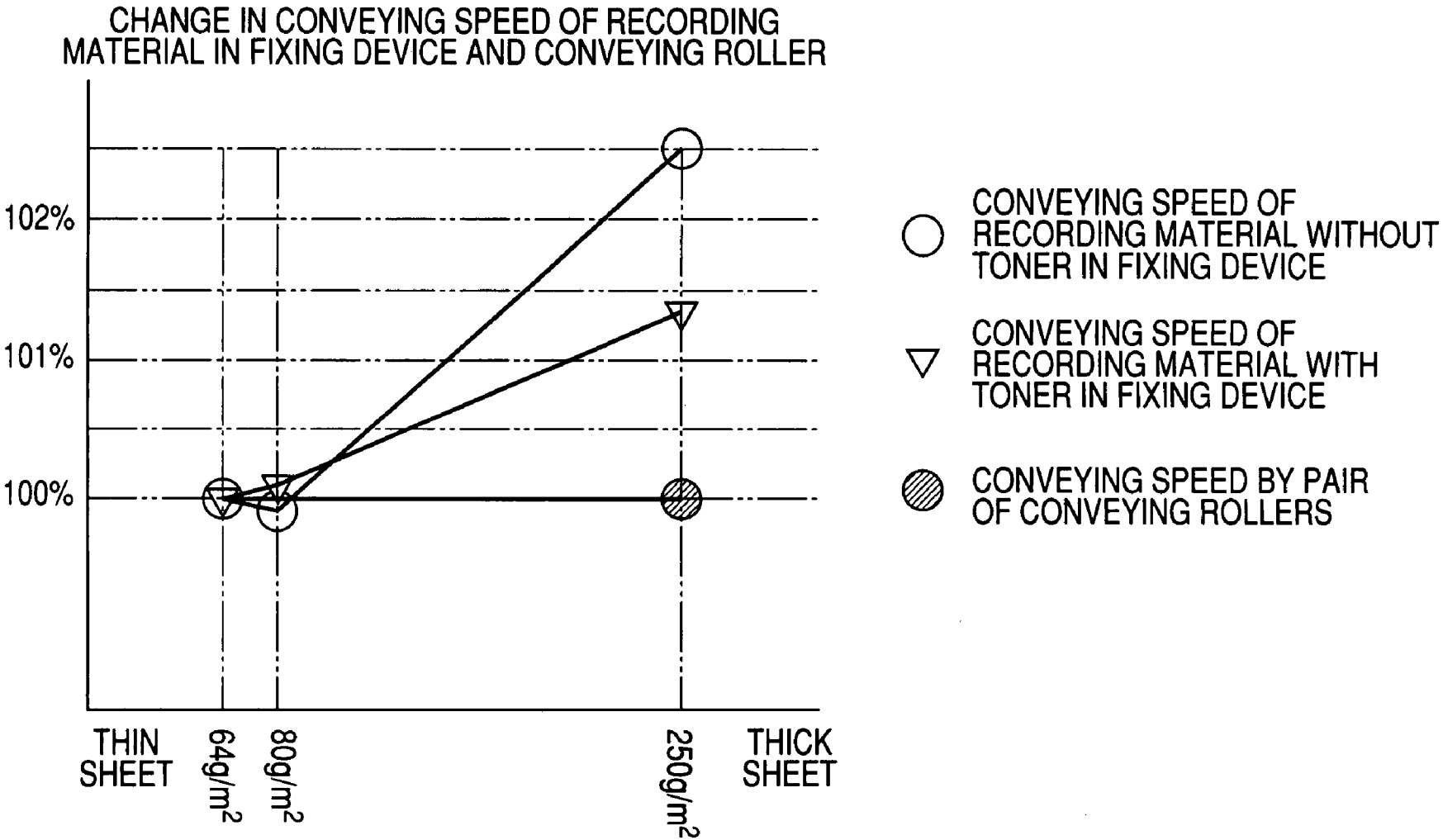
FIG. 3 is a graph illustrating the unevenness of the conveying speed of a recording material due to the differences in the thickness of the recording material and the bearing amount of a toner in the first embodiment of the fixing means provided in the image forming apparatus according to the present invention.
Figure 4:
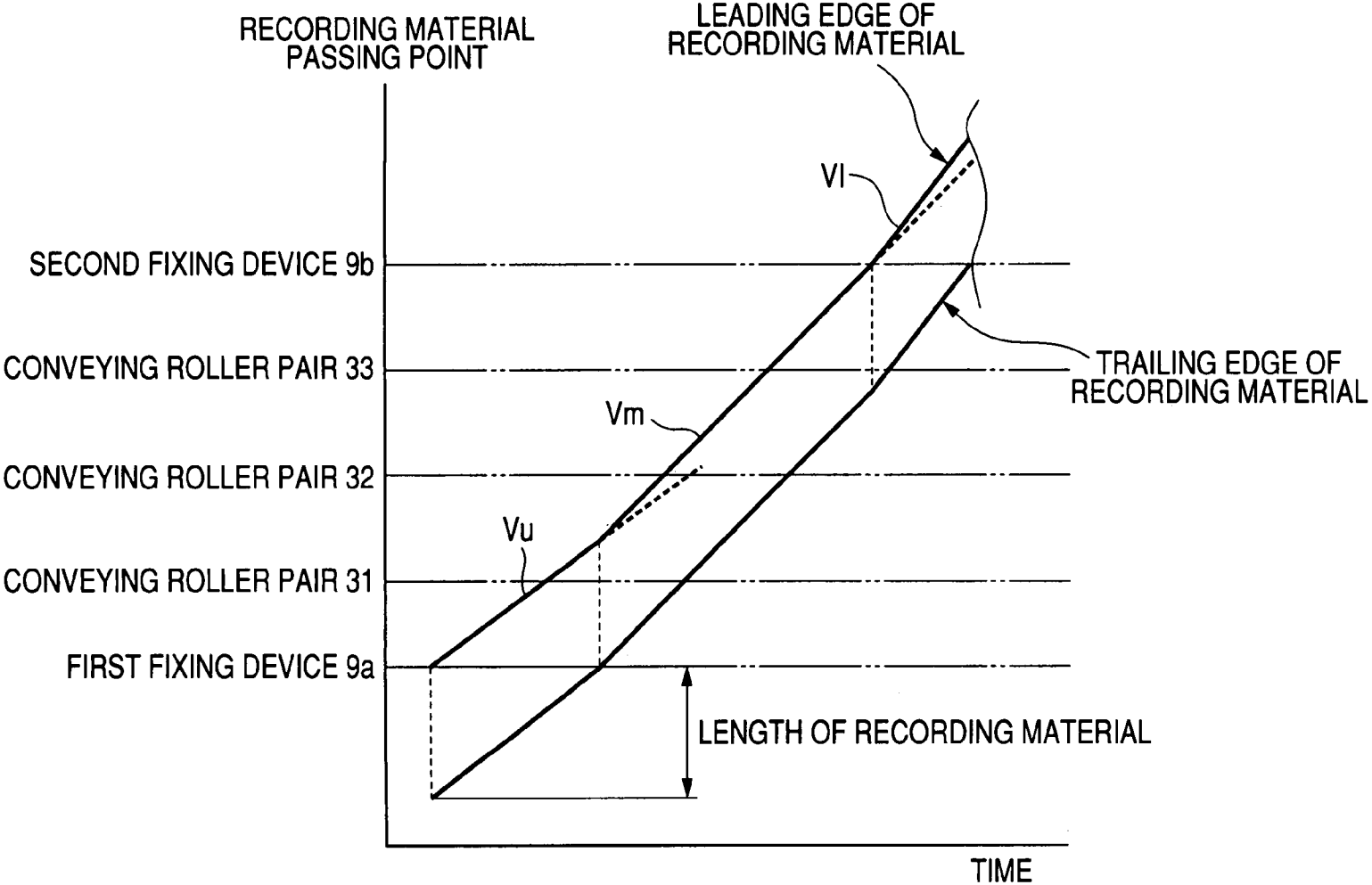
FIG. 4 is a diagram showing the conveying speed of the recording material in the fixing portion of the image forming apparatus according to the present invention.

FIG. 1 is a cross-sectional illustration showing the general construction of an image forming apparatus according to the present invention. FIG. 2 is a cross-sectional illustration showing the construction of a first embodiment of a fixing device provided in the image forming apparatus according to the present invention. FIG. 3 is a graph illustrating the unevenness of the conveying speed of a recording material due to the differences in the thickness of the recording material and the differences in the bearing amount of toner in the first embodiment of the fixing device provided in the image forming apparatus according to the present invention. FIG. 4 is a diagram showing the conveying speed of the recording material in the image fixing apparatus of the image forming apparatus according to the present invention.

First Embodiment

The construction of a first embodiment of an image forming apparatus provided with an image fixing apparatus F according to the present invention will first be described with reference to FIGS. 1 to 4. First, second, third and fourth image forming portions Pa, Pb, Pc and Pd are provided side by side in the image forming apparatus. In the image forming portions Pa, Pb, Pc and Pd, toner images of different colors are formed via a latent image forming process, a developing process and a transferring process.

The image forming portions Pa, Pb, Pc and Pd are provided with photosensitive drums 3*a*, 3*b*, 3*c* and 3*d*, respectively, as image bearing members on which exclusive toner images are formed. Toner images of respective colors are formed on the photosensitive drums 3*a*, 3*b*, 3*c* and 3*d*.

Around the respective photosensitive drums 3*a*, 3*b*, 3*c* and 3*d*, there are provided drum charging devices 2*a*, 2*b*, 2*c*, 2*d* which are charging means, developing devices 1*a*, 1*b*, 1*c*, 1*d* which are developing means, primary transfer charging devices 24*a*, 24*b*, 24*c*, 24*d* which are primary transferring means, and cleaners 4*a*, 4*b*, 4*c*, 4*d* which are cleaning means, and light source devices (not shown) and polygon mirrors (not shown) are further installed in the upper portion of the image forming apparatus.

Laser beams emitted from the respective light source devices are scanned by the polygon mirrors being rotated, and the scanned beams are deflected by deflecting mirrors and are corrected by fθ lenses so that the optical path lengths thereof may be constant, and are condensed on the generatrices of the respective photosensitive drums 3*a*, 3*b*, 3*c* and 3*d* to thereby expose these drums to the beams, whereby electrostatic latent images conforming to an image signal are formed on the photosensitive drums 3*a*, 3*b*, 3*c* and 3*d*.

The developing devices 1*a*, 1*b*, 1*c* and 1*d* are filled with predetermined amounts of cyan, magenta, yellow and black toners, respectively, as developers by developer supplying devices (not shown). The developing devices 1*a*, 1*b*, 1*c* and 1*d* develop the electrostatic latent images on the photosensitive drums 3*a*, 3*b*, 3*c* and 3*d*, respectively, to thereby visualize these latent images as a cyan toner image, a magenta toner image, a yellow toner image and a black toner image.

Adjacent to the photosensitive drums 3*a*, 3*b*, 3*c* and 3*d*, there is installed an intermediate transfer member 130 which is a transfer member for transferring the toner images formed on the surfaces of the photosensitive drums 3*a*, 3*b*, 3*c* and 3*d* onto a recording material S which is a sheet comprised of paper, synthetic resin or the like.

The intermediate transfer member 130 is rotatively driven in the direction indicated by the arrow "a" at the same peripheral speed as the photosensitive drums 3*a* to 3*d*. The cyan toner image which is the first color borne on the photosensitive drum 3*a* is intermediately transferred onto the outer peripheral surface of the intermediate transfer member 130 by an electric field and pressure formed by a primary transferring bias voltage applied to the intermediate transfer member 130 by the action of the primary transfer charging device 24*a* in the process of passing through the nip portion between the photosensitive drum 3*a* and the intermediate transfer member 130.

Likewise, the magenta toner image, the yellow toner image and the black toner image which are the second to fourth colors borne on the photosensitive drums 3*b* to 3*d*, respectively, are successively superimposed and transferred onto the outer peripheral surface of the intermediate transfer member 130 by electric fields and pressure formed by primary transferring bias voltages applied to the intermediate transfer member 130 by the action of the primary transfer charging devices 24*b* to 24*d* in the process of passing through the nip portions between the photosensitive drums 3*b* to 3*d* and the intermediate transfer member 130, whereby a combined color toner image corresponding to a desired color image is formed.

A secondary transfer roller 11 which is secondary transferring means is supported in opposed relationship with and in parallelism to the intermediate transfer member 130 passed over tension rollers 13, 14 and 15 and is disposed in contact with the underside portion of the intermediate transfer member 130. A desired secondary transferring bias voltage is applied to the secondary transfer roller 11 by a secondary transferring bias voltage source.

The combined color toner image superimposed and transferred onto the intermediate transfer member 130 is transferred to the recording material S. The recording material S is conveyed from a feeding cassette 10*a* or 10*b* to each pair of rollers and is fed to the contact nip portion between the intermediate transfer member 130 and the secondary transfer roller 11 at predetermined timing past a pair of registration rollers 12 and an ante-transfer guide (not shown). When the recording material S is fed to the contact nip portion between the intermediate transfer member 130 and the secondary transfer roller 11, the secondary transferring bias voltage is applied from the secondary transferring bias voltage source to the secondary transfer roller 11. By the application of the secondary transferring bias voltage, the combined color toner image is transferred from the intermediate transfer member 130 to the recording material S.

As described above, the toner images of the respective colors formed on the photosensitive drums 3*a*, 3*b*, 3*c* and 3*d* are primary-transferred onto the intermediate transfer member 130, and are secondary-transferred onto the recording material S in a secondary transferring portion wherein the secondary transfer roller 11 is disposed.

On the other hand, the photosensitive drums 3*a* to 3*d* from which the primary transfer has been finished have any untransferred toners thereon removed by the respective cleaners 4*a* to 4*d*, and are continuedly used for the next electrostatic latent image forming process. Any toners and other foreign substances residual on the intermediate transfer member 130 may be wiped off by a cleaning web (non-woven fabric) 19 being brought into contact with the surface of the intermediate transfer member 130.

The image fixing apparatus F according to the present embodiment is provided with a first fixing device 9*a* and a second fixing device 9*b* as a plurality of fixing means for fixing the toner images transferred onto the recording material S while conveying the recording material S. The image fixing apparatus F has pairs of conveying rollers 31, 32 and 33 which are sheet conveying means between the first fixing device 9*a* and the second fixing device 9*b*. The respective ones of the pairs of conveying rollers 31, 32 and 33 are constituted by a conveying rotary member and a driven rotary member provided in opposed relationship with the conveying rotary member.

The recording material S onto which the toner images have been transferred by the intermediate transfer member 130 is conveyed while being nipped by and between a fixing roller 51 and a pressure roller 52 provided in each of the first fixing device 9*a* and the second fixing device 9*b*. The recording material S has the toner images thereon fixed by heat and pressure while being conveyed by the fixing roller 51 and the pressure roller 52. Thereafter, the recording material S is discharged as a recorded image out of the image forming apparatus. When an image is to be formed on the back side of the recording material S, the recording material is reversed by a recording material reversing path 91, and thereafter is again conveyed to the secondary transferring portion through the two-side conveying path 5, and an image is formed on the back side. The first fixing device 9*a* provided on the upstream side with respect to the conveying direction constitutes the first fixing means of the present invention, and the second fixing device 9*b* provided on the downstream side constitutes the second fixing means of the present invention.

The recording material S subjected to the transfer of the toner images is sequentially introduced into the first fixing device 9*a* and the second fixing device 9*b*, and heat and pressure are applied to the recording material S, whereby the toner images are fixed. FIG. 2 shows the basic construction of a heat roller type fixing device as a specific example of the fixing devices 9*a* and 9*b*. Each of the first fixing device 9*a* and the second fixing device 9*b*, as shown in FIG. 2, has the fixing roller 51 and the pressure roller 52 disposed in opposed relationship with the fixing roller 51. The fixing roller 51 has a mold releasable layer 70 provided on the surface of a cylindrical mandrel 71 containing therein a halogen lamp heater 56 which is a heating member. The pressure roller 52 has a heat-resistant rubber layer 72 provided around a bar-shaped mandrel 73, and a mold releasable layer 70 is further formed on the surface thereof. The conveyance of the recording material S is effected by the nip portion between the fixing roller 51 and the pressure roller 52 and at the same time, the toner images are fixed on the recording material S by heat and pressure.

The fixing roller 51 has a thermistor (not shown), disposed in contact or non-contact therewith, and a voltage to the halogen lamp heater 56 is controlled through a temperature adjusting circuit to thereby effect the temperature adjustment of the surface of the fixing roller 51.

In the fixing device, a silicone rubber layer impregnated with silicone oil may be provided instead of the mold releasable layer 70 on the surface of the fixing roller 51.

The construction of the fixing devices in the present embodiment will now be described in greater detail with reference to FIG. 2.

The first fixing device 9*a* and the second fixing device 9*b* are of the same construction.

The fixing roller 51 is provided with silicone rubber having a thickness of 1.0 mm on the cylindrical mandrel 71 formed of iron (Fe) and having an outer diameter ϕ (configurational diameter) of 78.0 mm. The fixing roller 51 has an outer diameter ϕ (configurational diameter) of 80 mm by further covering the surface of the silicone rubber with a PFA (tetrafluoroethylene perfluoroalkyl ether copolymer) tube having a thickness of 30 μm. Also, the halogen lamp heater 56 is used in the interior of the fixing roller 51, and the surface temperature of the fixing roller is adjusted to 170° C.

The pressure roller 52 has the heat-resistant rubber layer 72 which is a sponge layer formed of silicone rubber provided around the bar-shaped mandrel 73 formed of iron (Fe) and having an outer diameter (configurational diameter) ϕ of 20 mm. The surface of the heat-resistant rubber layer 72 is covered with a PFA tube having a thickness of 30 μm. The outer diameter ϕ (configurational diameter) of the pressure roller 52 is 80 mm. The pressure roller 52 is urged against the fixing roller 51 with total pressure of 686.5 N (70 kgf), and is driven to rotate by the fixing roller 51.

The first fixing device 9*a* disposed on the upstream side (the right side in FIG. 1) of the conveying path of the recording material S and the second fixing device 9*b* disposed on the downstream side (the left side in FIG. 1) of the conveying path of the recording material S are provided at an interval greater than the length of the supposed longest recording material S of recording materials on which images are formed by the image forming apparatus. That is to said, a path length from The first fixing device 9*a* to The second fixing device 9*b* is longer than a length of longest recording material S supposed to convey. The pairs of conveying rollers 31, 32 and 33 which are sheet conveying rotary members for conveying the recording material S are provided between the first fixing device 9*a* and the second fixing device 9*b*.

FIG. 3 shows the unevenness of the conveying speed of the recording material S due to the differences in the thickness of the recording material S and the bearing amounts of the toners. "With toner" indicated in FIG. 3 is a solid image of a cyan image of 100% and a magenta image of 100%, thus an image percentage of 200% in total (when the maximum bearing amount of a single-color toner is 100% and the maximum bearing amount of the four colors is 400%).

The conveying speed of the recording material S by the fixing rollers 51 and the pressure rollers 52 in the fixing devices 9*a* and 9*b* becomes higher because due to the high nip pressure, the amount of deformation of the fixing rollers 51 increases as the recording material changes from a thin sheet to a thick sheet, and in the case of a solid image, becomes low as compared with the case of the absence of the toners because the fixing rollers 51 and the toners slip relative to each other during fixing.

Therefore, the unevenness of the conveying speed of the recording material S by the fixing roller 51 and the pressure roller 52 occurs by about 2.5%. On the other hand, the unevenness of the conveying speed of the recording material S by the pairs of conveying rollers 31 to 33 disposed between the fixing devices 9*a* and 9*b* is 0.1% or less irrespective of the types of sheets and the presence or absence of the toners because the pressure force is low and the toners are not fused.

With the above-noted unevenness of the conveying speed taken into account, the conveying speed at which the same recording material S is conveyed is set to the relation that $$Vu<Vm<Vl, \quad (1)$$

where Vu is the conveying speed of the recording material S by the fixing roller 51 and the pressure roller 52 which are a pair of first fixing rotary members provided in the first fixing device 9*a* disposed on the upstream side of the conveying path of the recording material S, Vm is the conveying speed of the recording material S by the pairs of conveying rollers 31, 32 and 33 provided between the first fixing device 9*a* and the second fixing device 9*b*, and Vl is the conveying speed of the recording material S by the fixing roller 51 and the pressure roller 52 which are a pair of second fixing rotary members provided in the second fixing device 9*b* disposed on the downstream side of the conveying path of the recording material S.

In the present embodiment, each conveying speed difference is set to 5% with the unevenness 2.5% of the conveying speed of the recording material S by the fixing roller 51 and the pressure roller 52, the fluctuation 1.5% in the fixing temperatures of the fixing devices 9*a* and 9*b*, and the unevenness 1% of the parts taken into account.

That is, in the relation among the above-mentioned conveying speeds Vu, Vm and Vl, the above-mentioned conveying speed at which the same recording material S is conveyed is further set to the relation that $$Vm/Vu \leqq 1.05 \text{ and } Vl/Vm \leqq 1.05. \quad \text{expression (2)}$$

If each conveying speed difference is made too great, the recording material S will come to have attached thereto the trace of the roller caused by each roller slipping when the recording material S is pulled. Also, the tensile force of the recording material S becomes high and therefore, the recording material S strongly rubs against a conveying guide (not shown) and thus, during the fixing of a second side in the two-side image forming process via the two-side path 5, the image on a first side strongly rubs against the conveying guide to thereby cause the injury of the guide, the peeling of the toners, etc.

FIG. 4 shows a diagram of the conveying speed of the recording material S in the fixing portion. In FIG. 4, the axis of ordinates indicates the passage points of the recording material S, the axis of abscissas indicates the passage time, and the inclination of the diagram indicates the conveying speed. When the recording material S is nipped by and between the fixing roller 51 and pressure roller 52 of the first fixing device 9*a*, the recording material S is conveyed at the conveying speed Vu by the fixing roller 51 and pressure roller 52 of the first fixing device 9*a*.

Even if the leading edge of the recording material S is nipped by and between the pairs of conveying rollers 31, 32 and 33 between the fixing devices 9*a* and 9*b*, the conveying force of the fixing roller 51 and pressure roller 52 of the first fixing device 9*a* is stronger than the conveying force of the pairs of conveying rollers 31, 32 and 33 and therefore, the pairs of conveying rollers 31, 32 and 33 slip and the recording material S is conveyed intactly at the conveying speed Vu by the fixing roller 51 and pressure roller 52 of the first fixing device 9*a*. That is, when the recording material S is nipped by all of the fixing roller 51 and pressure roller 52 of the first fixing device 9*a* and the pairs of conveying rollers 31, 32 and 33, the recording material and the pairs of conveying rollers 31, 32 and 33 frictionally contact with each other.

When the trailing edge of the recording material S leaves the nip portion between the fixing roller 51 and pressure roller 52 of the first fixing device 9*a*, the recording material S is conveyed at the conveying speed Vm by the pairs of conveying rollers 31, 32 and 33 higher by 5% than the conveying speed Vu by the fixing roller 51 and pressure roller 52 of the first fixing device 9*a*.

Next, when the leading edge of the recording material S is nipped by and between the fixing roller 51 and pressure roller 52 of the second fixing device 9*b*, the recording material S is conveyed at the conveying speed Vl by the fixing roller 51 and pressure roller 52 of the second fixing device 9*b* still higher by 5% than the conveying speed Vm by the pairs of rollers 31, 32 and 33.

Again in this case, the conveying force of the fixing roller 51 and pressure roller 52 of the second fixing device 9*b* is stronger than the conveying force of the pairs of conveying rollers 31, 32 and 33 and therefore, the pairs of conveying rollers 31, 32 and 33 slip and the recording material S is conveyed intactly at the conveying speed Vl by the fixing roller 51 and pressure roller 52 of the second fixing device 9*b*. That is, when the recording material S is nipped by all of the fixing roller 51 and pressure roller 52 of the second fixing device 9*b*, and the pairs of conveying rollers 31, 32 and 33, the recording material and the pairs of conveying rollers 31, 32 and 33 frictionally contact with each other.

Here, the pairs of conveying rollers 31, 32 and 33 are set to a nipping force lower than the normal nipping force of the pairs of conveying rollers in order to make the recording material S slip when they pull the fixing devices 9*a* and 9*b* on the upstream side and downstream side, respectively, thereof, and the total pressure of the pressure forces of the pairs of conveying rollers 31, 32 and 33 which are sheet conveying means and pairs of conveying rotary members provided between the fixing devices 9*a* and 9*b* which are a plurality of fixing means is set to 1N or less.

By the conveying speeds Vu, Vm and Vl of the recording material S are set as described above, it never happens that the recording material S slackens between the fixing devices 9*a* and 9*b* and therefore, the occurrence of an image injury caused by the toner-fixed surface of the recording material S being strongly urged against the conveying guide can be prevented. Also, such a problem as uneven gloss caused by the leading edge of the recording material S contacting with the nip portion between the fixing roller 51 and the pressure roller 52 at the entrance of the second fixing device 9*b* to thereby cause the occurrence of a loop in the recording material S can be lessened.

Further, the conveying guide G forming a sheet conveying path provided between the fixing devices 9*a* and 9*b* which are a plurality of fixing means is formed into a convex shape (a convex shape in FIG. 1) toward the toner-fixed surface side of the recording material S, as shown in FIG. 1. Accordingly, by the conveying guide G being formed into a convex shape toward the toner-fixed surface side, it never happens that the toner-fixed surface side of the recording material strongly rubs against the conveying guide G and therefore, such a problem as an image injury is solved better.

This is particularly effective in an apparatus using a plurality of fixing devices for the purpose of high productivity, because in such an apparatus, the toner images on the recording material S passed through only the first fixing device 9*a* are not sufficiently fixed and when the toner-fixed surface of the recording material S rubs against the guide surface of the conveying guide G, an image injury is liable to occur.

On two types of paper, i.e., high gloss paper of A3 size which is the maximum size of the recording material S which can be used in the present image forming apparatus under such a condition and having basis weight of 250 g/m$^2$, and two-side coat paper of A3 size and having basis weight of 310 g/m$^2$, a solid image of a cyan image 100% and a magnet image 100%, thus an image percentage of 200% in total (when the maximum bearing amount of a single-color toner was 100% and the maximum bearing amount of the four colors was 400%) was formed under an environment of 60 sheets per minute, a process speed of 300 mm/sec., room temperature of 15° C. and humidity of 10%.

Under the above-described experimental conditions, the image misregister due to the shock to the first fixing device 9*a* during the dashing of the recording material S into the second fixing device 9*b* which had occurred in the conventional image forming apparatus did not occur in the image forming apparatus according to the present embodiment, and it has become possible to obtain an image of uniform gloss.

Second Embodiment

Figure 5:
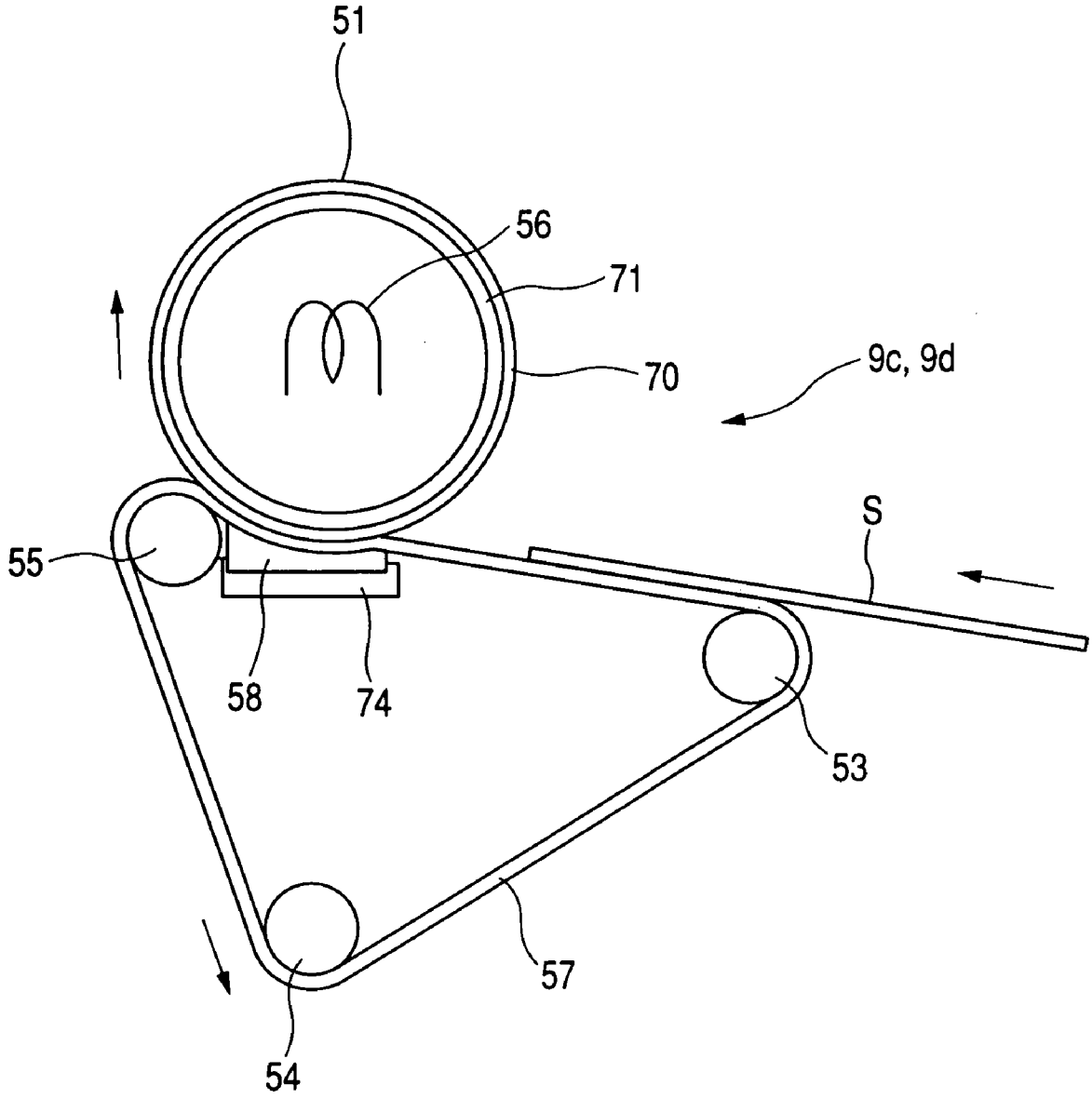
FIG. 5 is a cross-sectional illustration showing the construction of a second embodiment of the fixing means provided in the image forming apparatus according to the present invention.
Figure 6:
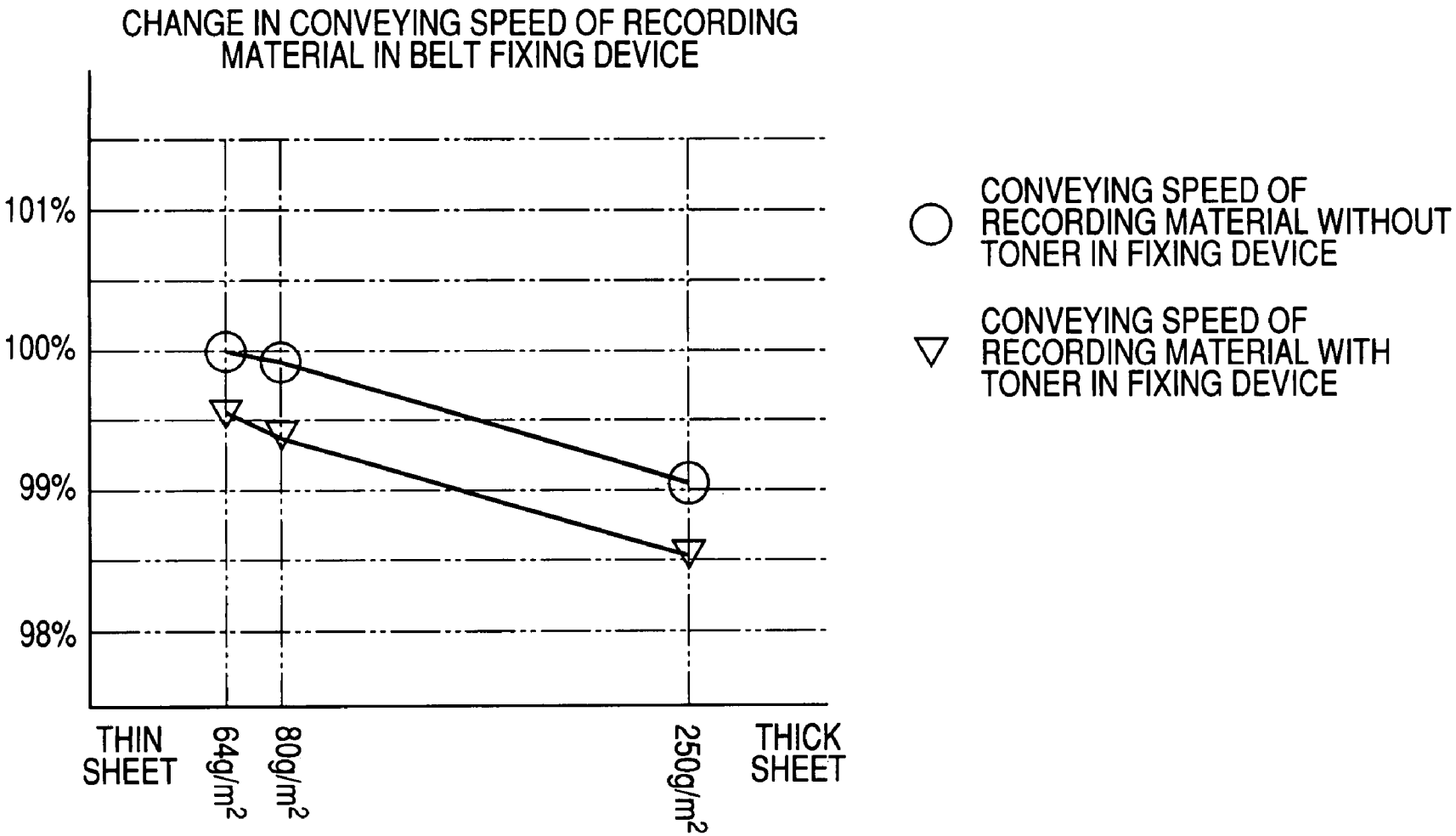
FIG. 6 is a graph illustrating the unevenness of the conveying speed of the recording material due to the differences in the thickness of the recording material and the bearing amount of a toner in the second embodiment of the fixing means provided in the image forming apparatus according to the present invention.

The construction of a second embodiment of the image forming apparatus provided with the image fixing apparatus according to the present invention will now be described with reference to FIGS. 5 and 6. FIG. 5 is a cross-sectional illustration showing the construction of a second embodiment of the fixing means provided in the image forming apparatus, and FIG. 6 is a graph illustrating the unevenness of the conveying speed of the recording material due to the differences in the thickness of the recording material and the bearing amount of the toners in the second embodiment of the fixing means provided in the image forming apparatus according to the present invention. Members constructed similarly to those in the aforedescribed first embodiment are given the same reference characters and need not be described.

In the aforedescribed first embodiment, description has been made of an example of the case where the fixing devices 9*a* and 9*b* constituted by the pairs of fixing rollers 51 and pressure rollers 52 are applied as the fixing means, but in the present embodiment, description will be made of an example of a case where as shown in FIG. 5, instead of the fixing devices 9*a* and 9*b* of FIG. 1, there are applied belt fixing devices 9*c* and 9*d* of a construction in which a fixing belt 57 passed over three tension rollers 53, 54 and 55 is brought into contact with a fixing roller 51 containing a halogen lamp heater 56 therein, and the fixing roller 51 is pressurized from the inside of the fixing belt 57 by a pressure pad 58 which is a pressure member.

Each of the first belt fixing device 9*c* provided on the upstream side with respect to the conveying direction and the second belt fixing device 9*d* provided on the downstream side, as shown in detail in FIG. 5, is of a construction having the rotatably disposed fixing roller 51, the fixing belt 57 comprising an endless belt passed over the plurality of tension rollers 53, 54 and 55 and rotated while being brought into pressure contact with the fixing roller 51, the pressure pad 58 for bringing the fixing belt 57 into pressure contact with the fixing roller 51, and a pressure pad supporting portion 74 for supporting the pressure pad 58. The first belt fixing device 9*c* provided on the upstream side with respect to the conveying direction constitutes the first fixing means of the present invention, and the second belt fixing device 9*d* provided on the downstream side constitutes the second fixing means of the present invention.

The fixing roller 51 is of a construction in which a cylindrical mandrel 71 formed of aluminum (Al) or iron (Fe) is covered with a mold releasable layer 70 comprising an elastic material layer of silicone rubber, fluorine resin or the like. The fixing belt 57 is of a construction in which the surface of a base material comprising resin such as polyimide or a metal such as nickel is covered with an elastic material layer of silicone rubber, fluorine rubber or the like.

The halogen lamp heater 56 is disposed in the interior of the fixing roller 51. Also, a thermistor (not shown) is disposed in contact or non-contact with the fixing roller 51, and a voltage to the halogen lamp heater 56 is controlled through a temperature adjusting circuit to thereby effect the temperature control of the surface of the fixing roller 51.

The tension roller 55 is constructed as a separating roller formed of a metal, and is pressurized so as to eat into the fixing roller 51 with the fixing belt 57 interposed therebetween to thereby deform the elastic material of the fixing roller 51 and separate the recording material S from the surface of the fixing roller 51. If as described above, the fixing nip portion is formed by the fixing roller 51, the fixing belt 57 and the pressure pad 58, it becomes possible to form a wide nip portion so as to twine on the outer periphery of the fixing roller 51, and this becomes advantageous for a higher speed.

Also, in the case of the fixing devices 9*a* and 9*b* provided by the pairs of fixing rollers 51 and pressure rollers 52 as in the aforedescribed first embodiment, the elastic material layer must be made thick when the nip width is to be secured widely, and the loss of heat transfer due to the elastic material layer is great, and this has been disadvantageous to energy saving, whereas in the belt fixing devices 9*c* and 9*d* using such fixing belts 57, it becomes possible to form a wide nip width without making the elastic material layer of the fixing roller 51 thick and therefore, it becomes possible to prevent the loss of heat transfer due to the elastic material layer, and this is effective for energy saving.

FIG. 6 shows the unevenness of the conveying speed of the recording material S due to the differences in the thickness of the recording material S and the bearing amount of toner in the belt fixing devices 9*c* and 9*d*. In the belt fixing devices 9*c* and 9*d*, the fixing nip portion is formed by the pressure pad 58 and therefore, it never happens that the pressure portion eats into the fixing roller 51 as in the roller fixing by the fixing roller 51 and the pressure roller 52 in the aforedescribed first embodiment, and the frictional resistance between the pressure pad 58 and the fixing belt 57 is great and therefore, the load of the pressure portion is greater and than the pressure by the pressure roller 52 in the aforedescribed first embodiment, and drivability is bad.

Therefore, the conveying speed of the recording material S in the belt fixing devices 9*c* and 9*d* becomes lower because the load of the pressure portion becomes greater and the fixing roller 51 and the recording material S slip more as the recording material changes from a thin sheet to a thick sheet. Also, as regards the presence or absence of the toners, in the case of a solid image, the fixing roller 51 and the toners slip during fixing irrespective of the thickness of the recording material S and therefore, the conveying speed becomes uniformly low as compared with a case where the toners are absent.

Thus, the unevenness of the conveying speed of the recording material S in the belt fixing devices 9*c* and 9*d* occurs by about 1.5%. Again in the belt fixing devices 9*c* and 9*d*, as in the fixing devices 9*a* and 9*b* in the aforedescribed first embodiment, with the fluctuation of 1.5% in the fixing temperature and the unevenness of 1% of the parts taken into account, the conveying speed at which the same recording material S is conveyed is set to the relation that $Vu<Vm<Vl$, where Vu is the conveying speed of the recording material S by the fixing roller 51 and the fixing belt 57 which are a pair of first fixing rotary members provided in the first fixing device 9*c* disposed on the upstream side of the conveying path of the recording material S, Vm is the conveying speed of the recording material S by the pairs of conveying rollers 31, 32 and 33 which are sheet conveying means and pairs of conveying rotary members provided between the first belt fixing device 9*c* and the second belt fixing device 9*d*, and Vl is the conveying speed of the recording material S by the fixing roller 51 and the fixing belt 57 which are a pair of second fixing rotary members provided in the second belt fixing device 9*d* disposed on the downstream side of the conveying path of the recording material S.

Also, in the relation among the conveying speeds Vu, Vm and Vl, the above-mentioned conveying speed is further set to the relation that $Vm/Vu \leqq 1.05$ and $Vl/Vm \leqq 1.05$.

By the difference among the above-described conveying speeds being set to 5%, the image misregister due to the shock to the first belt fixing device 9*c* when the recording material S dashed into the second belt fixing device 9*d* which occurred in the conventional image forming apparatus does not occur in the image forming apparatus according to the present embodiment, and it becomes possible to obtain a uniformly glossy image. In the other points, the present embodiment is constructed similarly to the aforedescribed first embodiment, and can obtain a similar effect.

Third Embodiment

In recent years, a desire for a recording material S which is a super-thick sheet (300 g/m$^2$ or greater) or the like to be also included in the specification of the image forming apparatus has heightened. In each of the aforedescribed embodiments, description has been made of a construction in which the pressure force of the pairs of conveying rollers 31, 32 and 33 between the plurality of fixing means is set low, and the pairs of conveying rollers 31, 32 and 33 are designed to make the recording material S slip when they pull the recording material S with each fixing means, but when the thickness of sheet increases, if the pressure force is low, the deficiency of the conveying force of the pairs of conveying rollers 31, 32 and 33 will occur, and if the pressure force is heightened, the pairs of conveying rollers 31, 32 and 33 will come to rub against the recording material S in the state of a high pressure force and thus, the traces of the rollers will be left on the recording material S.

Also, the tensile force of the recording material S becomes high and therefore, the recording material S strongly rubs against the conveying guide (not shown) and thus, during the fixing of the second side in the two-side image forming utilizing the two-side path 5, the toner image on the first side strongly rubs against the conveying guide to thereby cause an injury of the guide or the peeling of the toner or the like. Also, the pairs of conveying rollers 31, 32 and 33 are caused to slip on the surface of the recording material S to thereby give rise to the evil that the load of a driving system rises remarkably.

Figure 7:
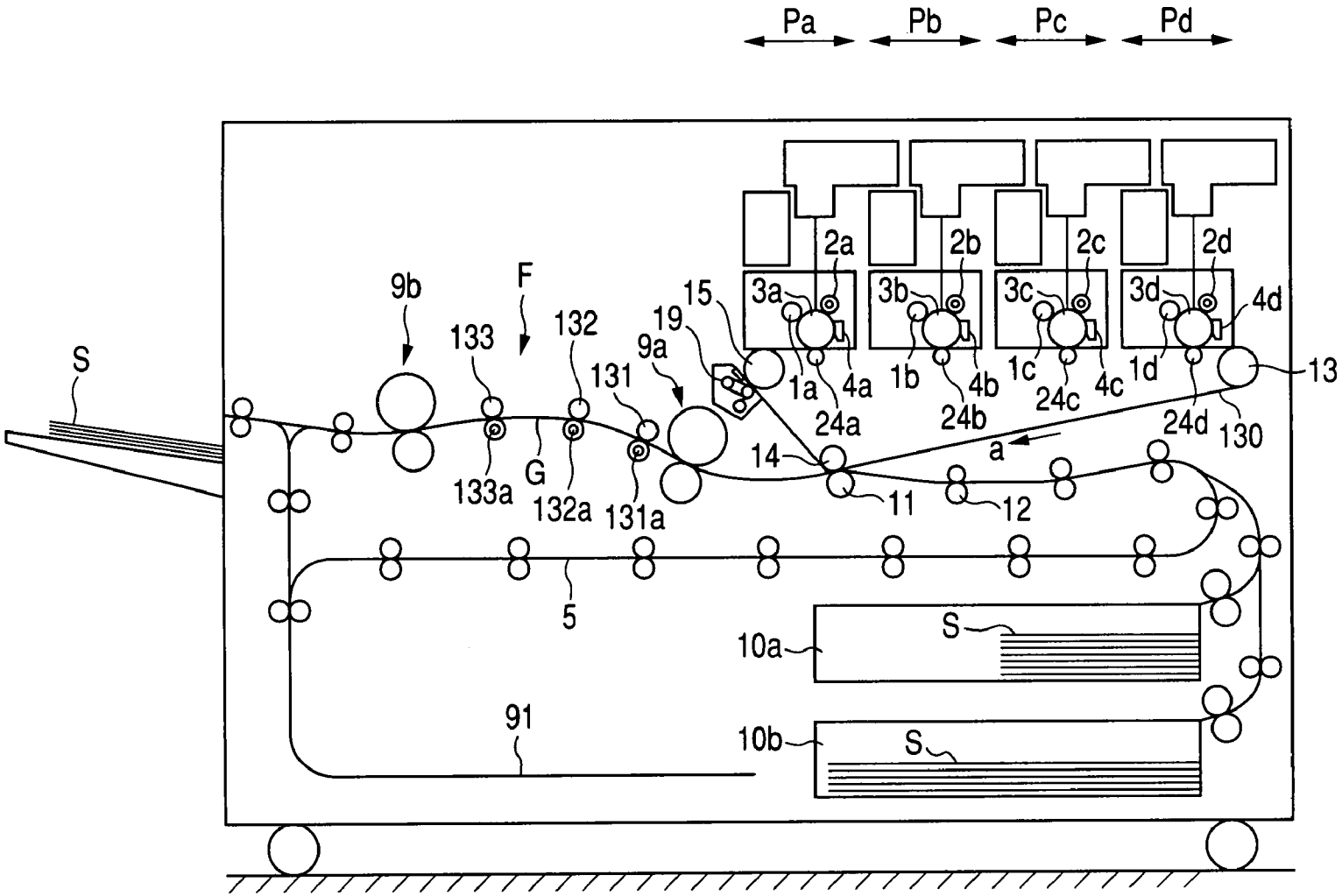
FIG. 7 shows the construction of a third embodiment of the image forming apparatus according to the present invention.

Therefore, in the present embodiment, as shown in FIG. 7, torque limiters 131*a*, 132*a* and 133*a* which are load limiting means for limiting a load to the recording material S are provided for the driving means of pairs of conveying rollers 131, 132 and 133 which are sheet conveying means or conveying rotary members disposed downstream of the first fixing device 9*a* which is fixing means with respect to the conveying path of the recording material S. In FIG. 7, members constructed similarly to those in the aforedescribed first embodiment are given the same reference characters and need not be described. As in the second embodiment, belt fixing devices may be used as the fixing means.

By the torque limiters 131*a*, 132*a* and 133*a* being thus provided for the driving means of the pairs of conveying rollers 131, 132 and 133, when a predetermined or greater tensile force is produced among the rollers of the pairs of conveying rollers 131, 132 and 133, the torque limiters 131*a*, 132*a* and 133*a* are operated, whereby the driving system slips and the rollers become capable of keeping a state in which the rollers grip the surface of the recording material S. By adopting the above-described construction, it becomes possible to always obtain a uniformly glossy image without adjusting the pressure force of the pairs of conveying rollers 131, 132 and 133 by the thickness of sheet or the like.

Also, in the present embodiment, description has been made of the effectiveness of using load limiting means for the pairs of conveying rollers 131, 132 and 133 which are conveying means between the fixing devices as the sheet conveying means disposed downstream of the fixing means with respect to the sheet conveying path, but even if the load limiting means is provided for the conveying rollers which are sheet conveying means disposed downstream of the fixing means with respect to the conveying path of the recording material, the excessive pulling or slack of the recording material S can be prevented, and it becomes possible to always obtain a uniformly glossy image. In the already described first embodiment, as the upstream side (or downstream side) fixing means of the two fixing means, a belt fixing device may be provided instead of the fixing device constituted by a pair of rollers.

In any of the above-described embodiments, the composition in which conveying rollers 31, 32 and 33 are provided as sheet conveying means between the first fixing device and the second fixing device was illustrated. However, it can be formed that a conveying belt is provided between first fixing device and second fixing device as sheet conveying means. In this case, to suck the sheet to the conveying belt, holes are formed on the conveying belt and the suck fan is installed.

In any of the above-described embodiments, it never happens that the sheet slackens between the plurality of fixing means, nor it happens that the toner-fixed surface of the sheet is strongly urged against the conveying guide or the like and therefore, no image injury occurs to the toner images. Also, no shock occurs to the recording material at the entrance of the fixing means disposed on the downstream side of the sheet conveying path and therefore, the occurrence of image misregister can be prevented. Also, a loop does not occur to the recording material at the entrance of the fixing device and therefore, the occurrence of uneven gloss can be prevented. Thereby, the behavior of the recording material between the plurality of fixing devices becomes stable, and there can always be obtained a uniformly glossy image free of the image misregister or image stains or the peeling of the toners due to the shock during the dash into the fixing device.

This application claims priority from Japanese Patent Application No. 2004-082315 filed on Mar. 22, 2004, which is hereby incorporated by reference herein.

What is claimed is:

1. An image fixing apparatus comprising:

a first fixing device which fixes a toner image on a sheet;

a second fixing device, provided downstream of said first fixing device, which fixes the toner image on the sheet passed though said first fixing device;

a sheet conveying path, provided between said first fixing device and said second fixing device, wherein a length of said sheet conveying path is longer than a length of a longest sheet to be able to convey; and a sheet conveying means, provided on the sheet conveying path, which conveys the sheet, wherein a relation among sheet conveying speeds of said first fixing device, said sheet conveying means and said second fixing device is set to $$Vu<Vm<Vl,$$

where Vu is a sheet conveying speed of said first fixing device, Vm is a sheet conveying speed of said sheet conveying means, and Vl is a sheet conveying speed of said second fixing device.

2. An image fixing apparatus according to claim 1, wherein further, the relation among the sheet conveying speeds is set to $$Vm/Vu \leqq 1.05 \text{ and } Vl/Vm \leqq 1.05.$$

3. An image fixing apparatus according to claim 1, wherein said sheet conveying path is formed so that a toner-fixed side of the sheet may become a convex shape.

4. An image fixing apparatus according to claim 1, said sheet conveying means has a pair of sheet conveying rotary members that nips and conveys a sheet, wherein a pressure force of said pair of sheet conveying rotary members against the sheet is 1N or less.

5. An image fixing apparatus according to claim 1, further comprising load limiting means for limiting a load to the sheet by said sheet conveying means.

6. An image fixing apparatus according to claim 5, wherein said sheet conveying means has a pair of sheet conveying rotary members that nips and conveys a sheet, and wherein said load limiting means is a torque limiter for limiting a torque of said pair of sheet conveying rotary members.

7. An image fixing apparatus according to claim 1, wherein the conveying force of said first fixing device is greater than the conveying force of said sheet conveying means and the conveying force of said second fixing device is greater than the conveying force of the sheet conveying means.

8. An image fixing apparatus according to claim 7, wherein when the sheet is being conveyed by both of said first fixing device and said sheet conveying means, the sheet and said sheet conveying means frictionally contact with each other, and when the sheet is being conveyed by both of said sheet conveying means and said second fixing device, the sheet and said sheet conveying means frictionally contact with each other.

9. An image forming apparatus comprising:

an image bearing member on which a toner image is formed;

a transfer member which transfers the toner image formed on said image bearing member onto a sheet;

a first fixing device which fixes the toner image on the sheet onto which the toner image has been transferred by said transfer member;

a second fixing device, provided downstream of said first fixing device, which fixes the toner image on the sheet passed though said first fixing device;

a sheet conveying path, provided between said first fixing device and said second fixing device, wherein a length of said sheet conveying path is longer than a length of longest sheet to be able to convey; and a sheet conveying means provided on said sheet conveying path;

wherein a relation among sheet conveying speeds of said first fixing device, said sheet conveying means and said second fixing device is set to $$Vu<Vm<Vl,$$

where Vu is a sheet conveying speed of said first fixing device, Vm is a sheet conveying speed of said sheet conveying means, and Vl is a sheet conveying speed of said second fixing device.

10. An image forming apparatus according to claim 9, wherein said sheet conveying path is formed so that a toner-fixed side of the sheet may become a convex shape.

11. An image forming apparatus according to claim 10, wherein the conveying force of said first fixing device is greater than the conveying force of said sheet conveying means and the conveying force of said second fixing device is greater than the conveying force of the sheet conveying means.

* * * * *

UNITED STATES PATENT AND TRADEMARK OFFICE

CERTIFICATE OF CORRECTION

PATENT NO. : 7,251,425 B2
APPLICATION NO. : 11/081717
DATED : July 31, 2007
INVENTOR(S) : Seiichiro Kameda It is certified that error appears in the above-identified patent and that said Letters Patent is hereby corrected as shown below:

ON THE COVER PAGE
At Item (56), Foreign Patent Documents, "11038819A" should read --11-038819A--.

COLUMN 1
Line 64, "such as thin sheets to thick sheets" should read --(such as thin sheets to thick sheets)--.

COLUMN 2
Line 43, "solve" should read --solves--.

COLUMN 4
Line 10, "2c," should read --2c--.
Line 11, "2d" should read --and 2d--, and "1c," should read --1c--.
Line 12, "1d" should read --and 1d--.
Line 13, "24c, 24d" should read --24c and 24d--.
Line 14, "4c, 4d" should read --4c and 4d--.

COLUMN 5
Line 65, "two-side" should read --two-sided--.

COLUMN 6
Line 66, "said," should read --say,--.
Line 67, "The first" should read --the first--; and "The second" should read --the second--.

COLUMN 7
Line 2, "supposed" should read --is supposed--.

COLUMN 8
Line 5, "two-side" should read --two-sided-- (both occurrences).

UNITED STATES PATENT AND TRADEMARK OFFICE

CERTIFICATE OF CORRECTION

PATENT NO. : 7,251,425 B2
APPLICATION NO. : 11/081717
DATED : July 31, 2007
INVENTOR(S) : Seiichiro Kameda It is certified that error appears in the above-identified patent and that said Letters Patent is hereby corrected as shown below:

COLUMN 9
Line 37, "two-side coat paper" should read --two-sided coated paper--.

COLUMN 12
Line 18, "two-side" should read --two-sided--.
Line 19, "two-side" should read --two-sided--.

Signed and Sealed this

Twenty-seventh Day of May, 2008

JON W. DUDAS
*Director of the United States Patent and Trademark Office*